US009138755B2

(12) United States Patent
Schroeder

(10) Patent No.: US 9,138,755 B2
(45) Date of Patent: Sep. 22, 2015

(54) SHOWERHEAD OR HAND SHOWER

(71) Applicant: Grohe AG, Hemer (DE)

(72) Inventor: Claudia Schroeder, Iserlohn (DE)

(73) Assignee: Grohe AG, Hemer (DE)

( * ) Notice: Subject to any disclaimer, the term of this patent is extended or adjusted under 35 U.S.C. 154(b) by 118 days.

(21) Appl. No.: 14/056,333

(22) Filed: Oct. 17, 2013

(65) Prior Publication Data

US 2014/0034755 A1 Feb. 6, 2014

Related U.S. Application Data

(63) Continuation of application No. PCT/EP2012/001561, filed on Apr. 11, 2012.

(30) Foreign Application Priority Data

Apr. 18, 2011 (DE) ..... 10 2011 017 434

(51) Int. Cl.

| | |
|---|---|
| ***B05B 1/18*** | (2006.01) |
| ***B05B 1/16*** | (2006.01) |
| ***B05B 7/04*** | (2006.01) |
| ***E03C 1/04*** | (2006.01) |

(52) U.S. Cl.

CPC ..... *B05B 1/185* (2013.01); *B05B 1/1609* (2013.01); *B05B 1/18* (2013.01); *B05B 7/0425* (2013.01); *E03C 1/0409* (2013.01)

(58) Field of Classification Search

CPC ..... B05B 1/16; B05B 1/1609; B05B 1/1681; B05B 1/169; B05B 1/18; B05B 7/0425; B05B 1/185; E03C 1/0409; E03C 1/046

See application file for complete search history.

(56) References Cited

U.S. PATENT DOCUMENTS

| | | | | |
|---|---|---|---|---|
| 6,145,757 | A * | 11/2000 | Knapp | 239/443 |
| 2010/0237160 | A1 | 9/2010 | Miller et al. | |
| 2011/0215174 | A1* | 9/2011 | Chen | 239/310 |

FOREIGN PATENT DOCUMENTS

| | | | |
|---|---|---|---|
| CN | 100 427 215 | C | 10/2008 |
| CN | 100 427 218 | C | 10/2008 |
| CN | 101462096 | A * | 6/2009 |
| CN | 201 644 257 | U | 11/2010 |
| DE | 36 37 470 | C2 | 4/1995 |
| WO | WO 2007/026153 | A1 | 3/2007 |
| WO | WO 2009/006755 | A1 | 1/2009 |

* cited by examiner

*Primary Examiner* — Darren W Gorman

(74) *Attorney, Agent, or Firm* — Muncy, Geissler, Olds & Lowe, P.C.

(57) ABSTRACT

A showerhead or hand shower with spray outlet openings and at least one valve that controls the inflow of a fluid to the spray outlet openings, wherein the valve comprises a movable valve body via which at least a first and a second valve position are realized. A pushbutton is arranged for controlling the valve and provision is made to provide at least one additional valve for controlling the inflow of a second fluid, which valve is coupled to the at least one valve and is controlled or actuated substantially simultaneously with it through its associated pushbutton.

13 Claims, 8 Drawing Sheets

SHOWERHEAD OR HAND SHOWER

This nonprovisional application is a continuation of International Application No. PCT/EP2012/001561, which was filed on Apr. 11, 2012, and which claims priority to German Patent Application No. DE 10 2011 017 434.6, which was filed in Germany on Apr. 18, 2011, and which are both herein incorporated by reference.

BACKGROUND OF THE INVENTION

1. Field of the Invention

The present invention relates to a showerhead or hand shower.

2. Description of the Background Art

Most showerheads or hand showers have showerhead plates or spray face plates with multiple spray types. To this end, two or more groups of different spray outlet openings that are supplied with water separately or together are customarily arranged in the spray face plates. Inflow to the spray outlet openings is regulated by means of valve devices.

An extremely wide variety of solutions for switching the water inflow from one spray type to another are known from the prior art.

From US 2010/0237160 A1 is known a hand shower with multiple groups of spray outlet openings and multiple valves, wherein each valve is associated with a group of spray outlet openings. Each valve comprises an axially movable valve closing body that can be moved from a closed position to an open position by an actuation of a push-button, and back into the closed position by another actuation of the push-button. In this design, each individual valve can be controlled independently of the others.

SUMMARY OF THE INVENTION

It is therefore an object of the present invention to provide a showerhead or hand shower with multiple spray outlet openings and/or multiple spray types whose inflow can be controlled via valves.

In an embodiment, the invention provides a showerhead or hand shower that has multiple spray outlet openings and at least one valve that regulates the inflow of a fluid to the spray outlet openings. The valve has a movable valve body by means of which at least two defined valve positions can be realized. Examples of defined valve positions are the flow position and closed position of a valve. A pushbutton is provided for the purpose of controlling the valve, wherein this control is accomplished by actuating the pushbutton and thus actuating the associated valve body. When the pushbutton is actuated, the valve body is moved from the first valve position to the second valve position. In addition to the directly controllable valve, at least one additional valve is provided in the showerhead for controlling the inflow of a second fluid, which valve is coupled to the directly controllable valve and is actuated substantially simultaneously with it through its associated pushbutton. This additional valve does not have a separate pushbutton, and thus cannot be activated directly. Consequently, actuation of this additional valve takes place strictly through the directly controllable valve coupled to it.

While the first fluid is normally understood to be the shower water that travels from a fitting through a hose to arrive at the shower head, possibilities for the second fluid include air, a mixture of water and air, or even an emulsion intended to be mixed with the shower water.

According to the invention "x" ($x \geq 1$) directly controllable valves with "x" pushbuttons can also be arranged on or in the showerhead or hand shower. By means of each of the "x" valves, a spray type is then activated that is defined by the type and size of the spray outlet openings or the type of fluid that emerges from the spray outlet openings. In addition, one or more additional valves can be coupled to each of the "x" directly controllable valves.

Customarily, the water inflow to certain spray outlet openings is enabled by means of a directly controllable valve, by which means a first spray type is defined. By means of a valve coupled thereto, air can additionally be drawn in from an air intake passage. Because the spray has a different appearance and a different effect on account of the mixing of the two fluids, a different spray type is produced even if the water emerges from the same spray outlet openings as the first spray type.

In all cases, each of the valves comprises a valve seat and a movable valve body. The valve body can be one-piece or multi-piece. It has a first region that is provided for a sealing function, the so-called seal body, and a second region, the so-called tappet, which is provided for guiding the valve body. The tappet is mounted in a radially fixed and axially movable manner so that the valve body can be moved in the direction of its longitudinal axis. In addition, the valve body is spring mounted. The mounting can be implemented by means of a separate travel limiting spring or by means of a spring element that is part of the valve body. If the valve body is multi-piece in design, the tappet and seal body can be positioned axially relative to one another by means of pegs. In addition, the valves have a seal element in the form of a sealing ring that is provided on the valve body or on the valve seat.

The pushbuttons of the directly controllable valves are connected to the valve body in such a manner that the latter completes a certain motion when the pushbutton is actuated. The direction of motion of the pushbutton and valve body correspond here. When the pushbutton is actuated, the travel limiting spring or the spring element is compressed by means of the valve body. The resetting of the valve body out of the second valve position takes place because of the spring force of the return spring. The resetting can be accomplished automatically through a control element provided in the showerhead when another valve is activated or when another pushbutton is actuated. This is accomplished in that the valve body is released from a lock position. The lock position and/or release position is defined here by the control element or the position of the control element.

In an embodiment, multiple different fluid distribution chambers can be provided in the showerhead. The fluid distribution chambers can have at least one inlet opening and one outlet opening. Regardless of the shape and number of the inlet and outlet openings, fluid distribution chambers can be provided which just one fluid flows into and out of. In addition, fluid distribution chambers are provided that serve to mix at least two fluids. For example, air and water can be mixed in a fluid distribution chamber to produce an aerated spray. In addition, water can be mixed with other liquid or gaseous additives.

Multiple fluid distribution chambers can be provided in the showerhead that stand in connection with the spray outlet openings. Oftentimes the spray outlet openings of the individual fluid distribution chambers have different sizes and/or shapes. At least one valve can be arranged for each fluid distribution chamber that controls the inflow of a fluid into the fluid distribution chamber. In this context, this can be a valve that is directly controllable through a pushbutton or a valve that is coupled to a directly controllable valve. Depending on the desired application, the valves can be provided for controlling the inflow of water, air, water with dissolved additives, and/or emulsions.

An embodiment of the invention provides that each valve can be in a closed position in the first valve position and is in a flow position in the second valve position. When the valve body is moved out of the first valve position into the second, this movement takes place in opposition to the force of the return spring.

An embodiment of the invention provides a control element that is suitable for guiding all "x" directly controllable valve bodies and/or for automatically resetting these valve bodies from the second valve position to the first one. To this end, the directly controllable valve bodies have a guide element that can be provided in the form of a peg or cone. The control element can be provided as a rotatable gate disc or a translationally movable gate slide, for example. At least one gate for guiding at least one valve body can be provided on the control element. When actuation of a valve and the associated movement of a valve body take place, a movement of the control element in opposition to the force of a return spring takes place at the same time. In addition, the control element serves as a locking element for the directly controllable valve bodies in the applicable valve positions. To this end, one or more receptacles for each valve body are provided on the control element, which receptacles define the first or second valve position.

Because of the individual arrangement of the valves and the associated optional actuation, for showerheads with "x" valves that are directly controllable through pushbuttons and with the associated "x" individual spray types, there are "$2^x-1$" possibilities for different spray types or combinations of spray types.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
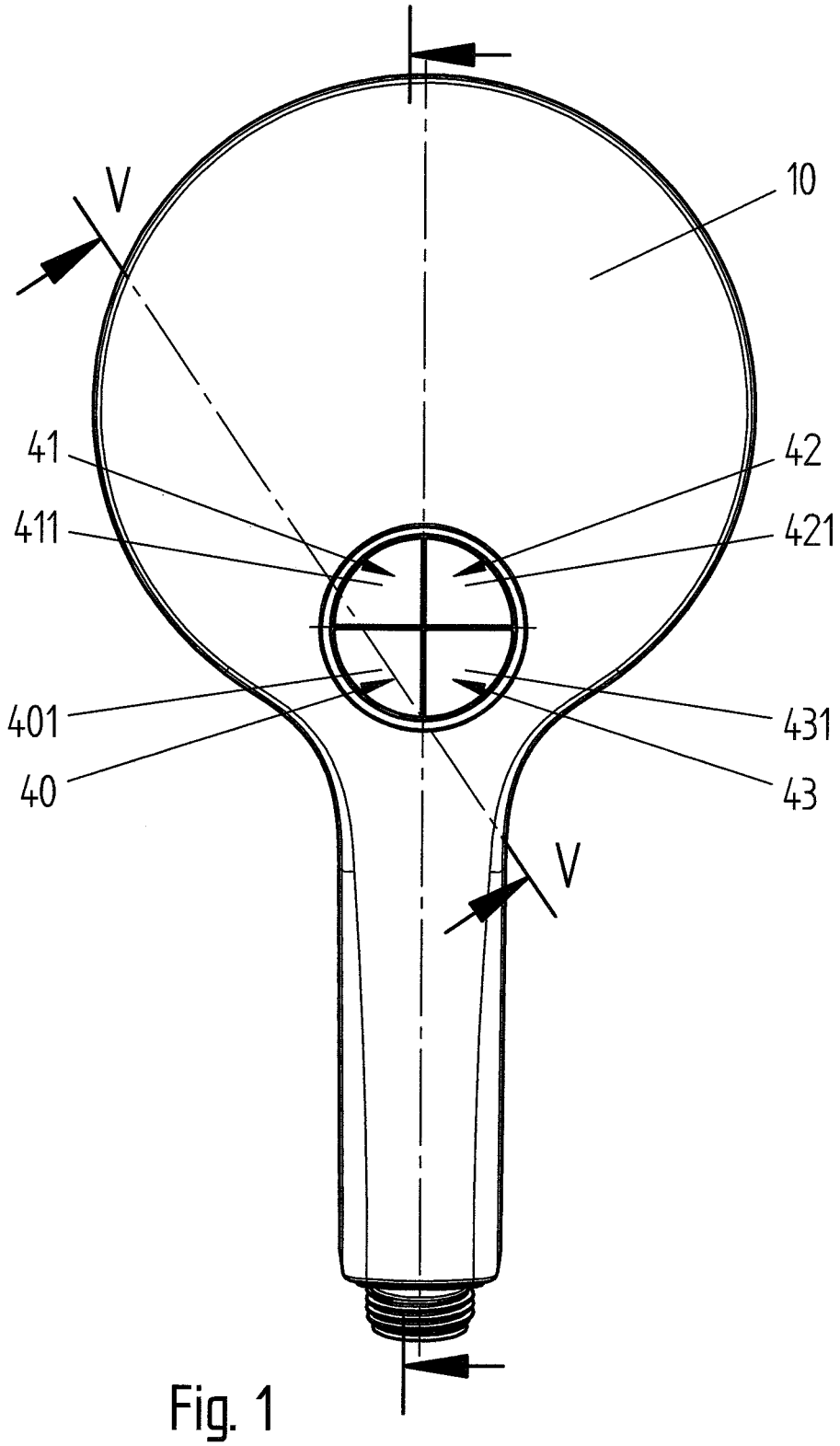
FIG. 1 is a top view of a hand shower according to an embodiment of the invention.

FIG. 1 shows a top view of a hand shower according to the invention; arranged on the top side thereof are four pushbuttons 401, 411, 421, 431 that are provided for actuating at least four valves 40, 41, 42, 43. In the present example embodiment, the pushbuttons 401, 411, 421, 431 have the shape of a segment of a circle, and in their arrangement produce a circular operating panel. Customarily the pushbuttons 401, 411, 421, 431 are labeled with a symbol or lettering that indicates the spray type that can be selected. In addition, the pushbuttons 401, 411, 421, 431 are arranged in a region of a housing 10 that allows the user convenient actuation of the pushbuttons 401, 411, 421, 431 when he is holding the showerhead in his hand.

In the present example embodiment, four individual spray types are provided. In addition, three different types of spray outlet openings 50 are provided. An individual spray type can be selected by actuating a single pushbutton 401, 411, 421, 431. In this design, it is possible to choose between a normal spray with a plurality of individual sprays, an aerated spray, a hard spray with a large spray diameter, and a massage spray with a movable spray pattern. Since it is also possible to actuate all pushbuttons 401, 411, 421, 431 simultaneously, a plurality of combinations of the different individual spray types is possible.

Figure 2:
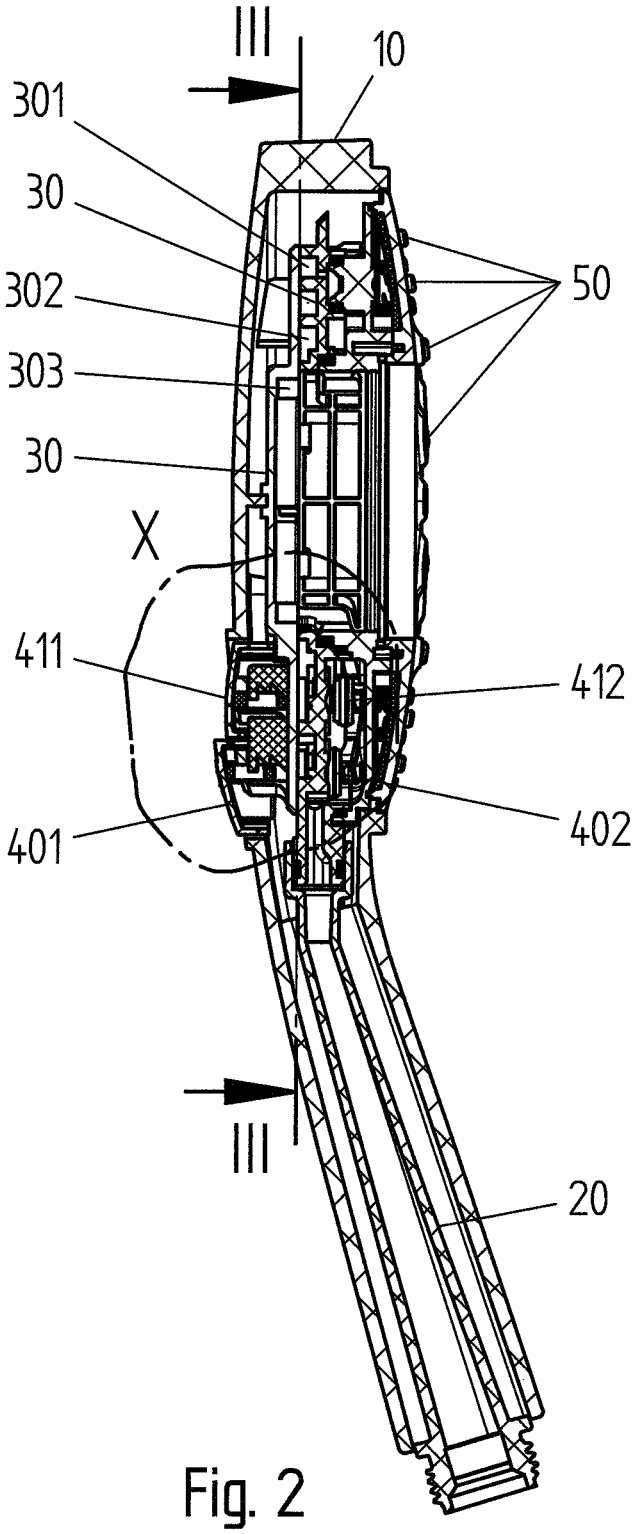
FIG. 2 is a section through the hand shower from FIG. 1.

The structure of the hand shower is evident from FIG. 2. Arranged in the housing 10 are a handle water passage 20 and a head water passage 30. The head water passage 30 contains multiple fluid distribution chambers 301, 302, 303, 304 and the associated valves 40, 41, 42, 43, 80 that control the inflow of at least one fluid per fluid distribution chamber 301, 302, 303, 304. In addition, multiple spray faceplate units that have different types of spray outlet openings 50 are arranged on the bottom of the head water passage 30. Each of the valves 40, 41, 42, 43, 80 includes a valve seat, which is located in the region of the inlets to the fluid distribution chambers 301, 302, 303, 304 on the head water passage 30. In addition, each valve 40, 41, 42, 43, 80 has a movable valve body 402, 412, 422, 432, 802, which includes a guide region, for example a tappet, and a sealing region, for example a seal body. In the present example embodiment, an annular seal element 403, 413, 423, 433 is arranged in the sealing region of each valve body 402, 412, 422, 432, 802. In addition, each of the valves 40, 41, 42, 43, 80 has a return spring 404, 414, 424, 434 that presses the valve body 402, 412, 422, 432, 802 against the relevant valve seat. This ensures that the valves 40, 41, 42, 43, 80 are leak-tight even when the water pressure in the water passage 20, 30 is low.

Figure 3:
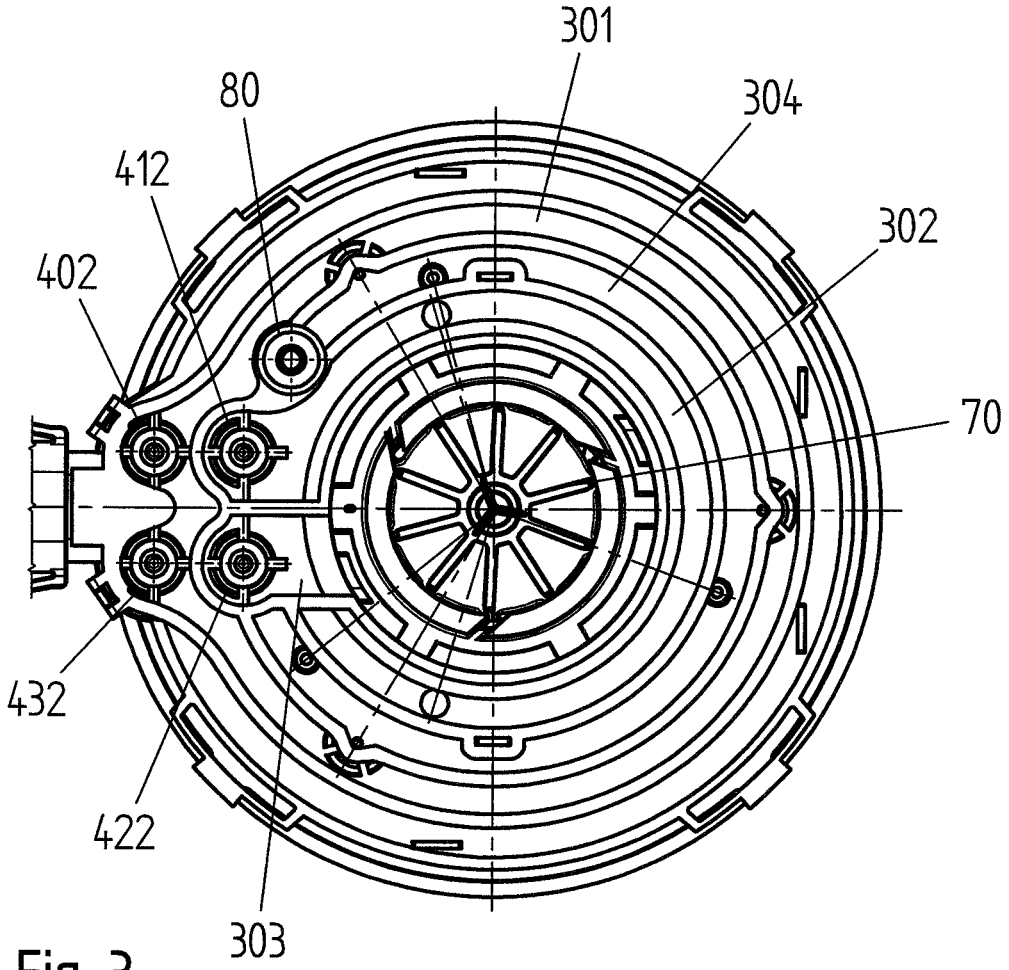
FIG. 3 is a section through the hand shower from FIG. 2 along the line III-III.

The arrangement of the fluid distribution chambers 301, 302, 303, 304 and their associated valves 40, 41, 42, 43 is clear from FIG. 3. In the present example embodiment, four fluid distribution chambers 301, 302, 303, 304 in all are provided, which are arranged to be largely concentric to the center point of the circular showerhead. A gear unit 70 that serves to produce a massage spray is located in the inner region of the showerhead. To this end, spray outlet openings 50 are provided on movably arranged spray nozzles. The gear unit 70 for driving the spray nozzles is supplied with water through the fluid distribution chamber 303. When the pushbutton 421 is actuated and depressed, the associated valve body 422 is displaced. This raises the valve body 422 from its valve seat and moves it in opposition to the force of a return spring 424. When this occurs, the inflow of water from the water passage 20, 30 into the fluid distribution chamber 303 is enabled.

The inflow to the fluid distribution chamber 302 is controlled through the pushbutton 411 and the associated valve 41 or the associated valve body 412. The fluid distribution chamber 302 stands in connection with spray outlet openings 50 that produce a spray with fairly large spray diameter, a so-called "jet" spray. Inflow to the fluid distribution chamber 301 is controlled through the valves 40, 43 and the associated pushbuttons 401, 431. When the pushbutton 431 is actuated, only the valve body 432 is moved to a flow position. When this occurs, the inflow of water to the fluid distribution chamber 301 is enabled. In this valve position, a normal spray with a plurality of individual sprays is produced by the spray outlet openings 50.

Figure 5:
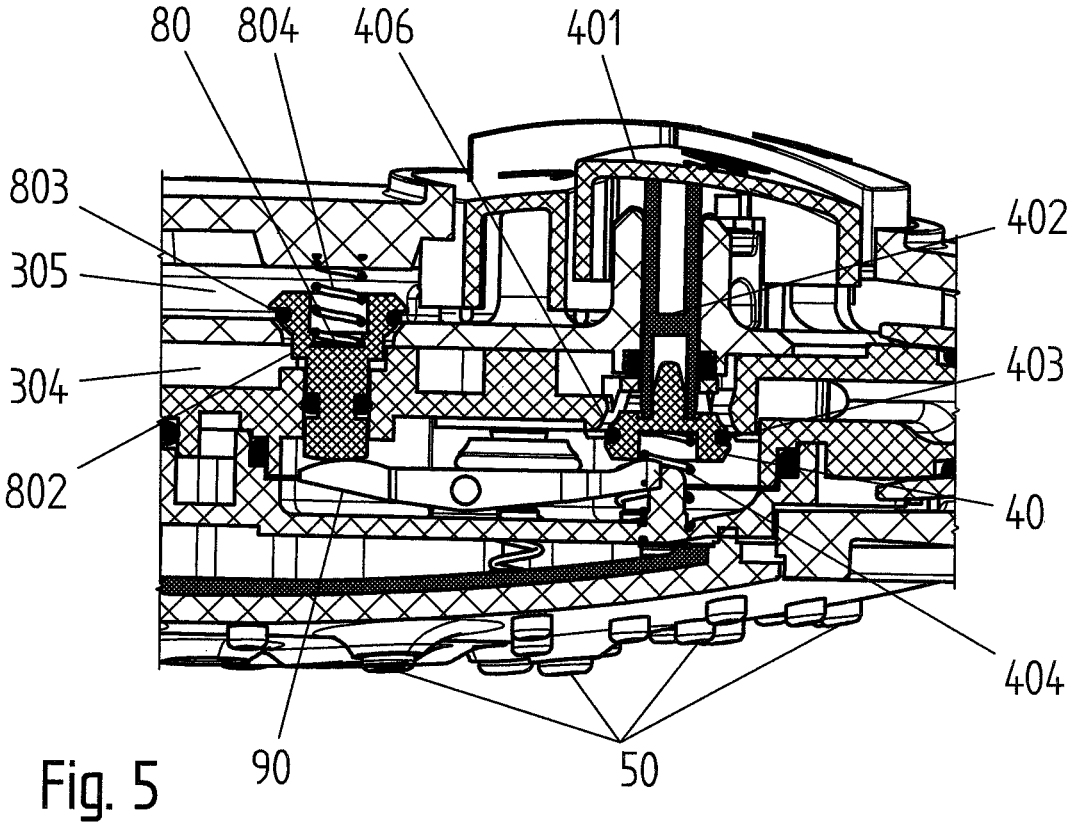
FIG. 5 is a detail view of a section through the hand shower from FIG. 2 along the line V-V.

It is evident from FIG. 5 that the valve 40 is also coupled to an additional valve 80. This valve is connected to the valve 40 by a lever/rocker 90. When the pushbutton 401 is actuated, the associated valve body 402, which is implemented in a two-piece design here, is displaced from its valve seat 406 to a flow position for the water so that the water can flow into the fluid distribution chamber 301. The valve body 402 includes a tappet and a seal body on which the seal element 403 is arranged. When the valve body 402 is displaced, it presses on one end of the lever/rocker 90, the other end of which acts on the valve body 802 and the spring 804, and raises the valve body 802 from its valve seat 803 as well. While the valve body 402 is moved downward by the pushbutton 401, the valve body 802 of the valve 80 is moved upward at the same time. This releases an opening to the fluid distribution chamber 304, which is an air distribution chamber that stands in connection with an air intake passage 305. The fluid distribution chambers 301 and 304 are arranged such that air can flow out of the fluid distribution chamber 304 and water can flow out of the fluid distribution chamber 301 into the mixing chamber located thereunder when the valve body 802 is moved into a flow position. In this valve position, an aerated shower spray is produced. The water exits the fluid distribution chamber 301 through the same spray outlet nozzles 50 as when the valve 43 is actuated. However, a visibly different spray, and thus a different spray type, is produced through the admixture of air.

The showerhead according to the invention makes it possible to select the spray types specifically and directly by actuating the relevant pushbuttons 401, 411, 421, 431. It is possible here to press the pushbuttons 401, 411, 421, 431 individually or in combination with one another. It is also possible to actuate all pushbuttons 401, 411, 421, 431 at once. The advantage of the invention is that an existing spray type or combination need not be deselected before it is possible to select a new spray type. Instead, the existing selection is automatically deselected when a new spray type is selected by actuating a pushbutton. This is accomplished by means of a control element 60 that serves to guide the valve bodies 402, 412, 422, 432. To this end, the valves 40, 41, 42, 43 have a guide element 405, 415, 425, 435.

The mode of operation is explained in detail using FIGS. 4*a* through 4*d*. The control element 60 is arranged between or on the valves 40, 41, 42, 43 such that it is always in contact with all guide elements 405, 415, 425, 435 in some form. The control element 60 is provided in the form of a one-piece, movable gate disc which must be moved in opposition to the force of a return spring during a motion. The direction of motion of the control element 60 is perpendicular to the direction of motion of the valve bodies 402, 412, 422, 432.

Figure 4A:
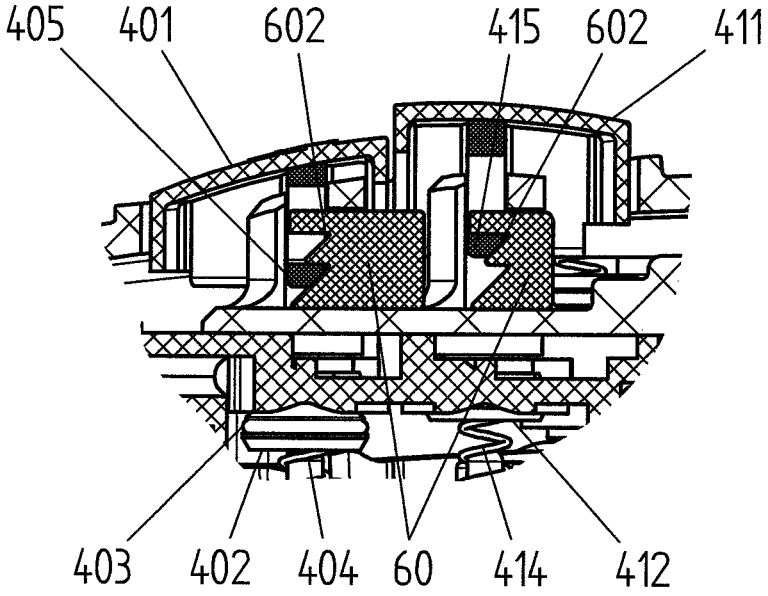
FIG. 4*a* illustrates the detail "X" from FIG. 2.

In FIG. 4*a*, the pushbutton 411 of the valve 41 is in a non-actuated position. The associated valve body 412 is in the first valve position, which corresponds here to the closed position of the valve 41. The seal element 413 of the valve body 412 rests against the valve seat. Inflow to the fluid distribution chamber 302 is thus blocked. A guide element 405 in the form of a peg is provided on the valve body 412 perpendicular to the valve body axis. The guide element 405 has a trapezoidal cross-section. In the depicted first valve position of the valve 41, the guide element 415 is located in a first receptacle 602 of the control element 60. Because of the geometry of the guide element 415 and receptacle 602, the valve body 412 and the pushbutton 405 connected thereto are secured in this first valve position even though the return spring 414 presses against the valve body 412, since the control element 60 is mounted so as to be immovable in the direction of the valve travel. In contrast thereto, the pushbutton 401 is in an actuated position, so that the associated valve 40 is activated and is in the flow position. The associated valve body 402 is thus in the second valve position and rests in a receptacle 603 of the control element.

Figure 4B:
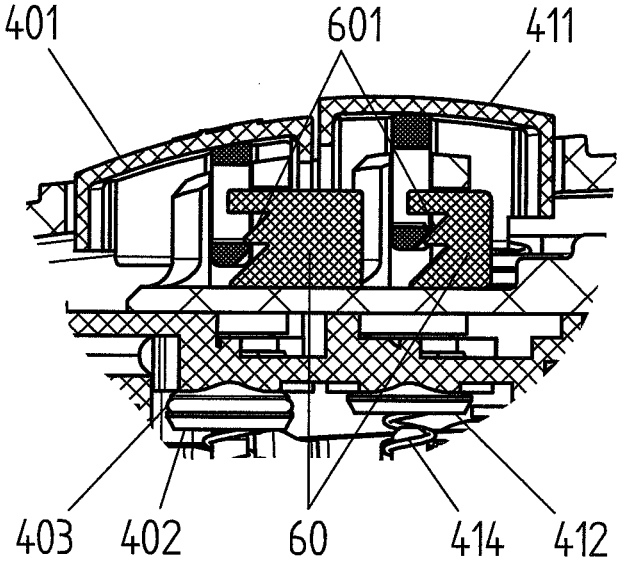
FIG. 4*b* illustrates the detail "X" from FIG. 2 with different pushbutton and valve positions.

In contrast thereto, in FIG. 4*b* the pushbutton 411 is currently in a non-secured position. The pushbutton 411 of the valve 41 is currently being actuated and pushed downward. In this process, a beveled edge of the guide element 415 slides along a gate 601 of the control element 60, moving the control element 60 in opposition to the force of a return spring. If the pushbutton 411 is pushed further downward without the pushbutton 401 simultaneously being actuated as well, the control element is moved far enough that the guide element 405 slides out of the receptacle 603. In this case, the valve body 402 would be pushed upward due to the restoring force of the return spring 404 until the guide element 405 reaches engagement with the receptacle 602. A further upward motion of the valve body 402 and the pushbutton 401 connected to it would then be blocked.

Figure 4C:
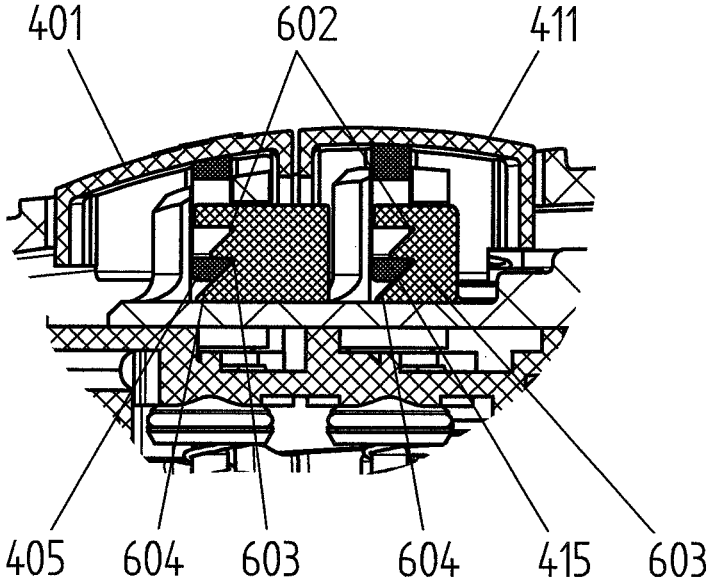
FIG. 4*c* illustrates the detail "X" from FIG. 2 with different pushbutton and valve positions.
Figure 4D:
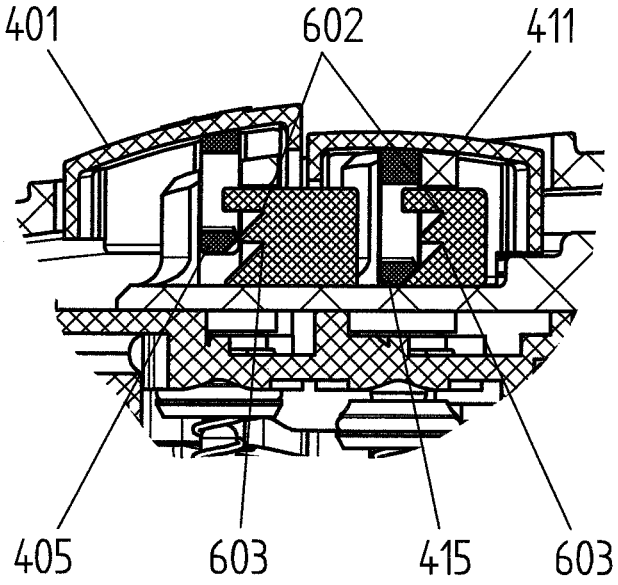
FIG. 4*d* illustrates the detail "X" from FIG. 2 with different pushbutton and valve positions.

In FIG. 4*c*, both valves 40, 41 are in the flow position. The associated valve bodies 402, 412 are in the second valve position and the associated guide elements are secured in the two receptacles 603 of the control element 60. In the hand shower according to the invention, it is possible to operate all four pushbuttons 401, 411, 421, 431 at the same time. In this situation, all valve bodies 402, 412, 422, 432 would be in the second valve position. Accordingly, then, all guide elements 405, 415, 425, 435 are secured in the associated receptacles 603 of the control element 60. FIG. 4*d* shows the situation when the spray type defined by the valve 41 is selected and the other valves are deselected by actuating the pushbutton 411.

The pushbutton 411 is pressed down to its stop position. When this occurs, the guide element 415 is also slid along the second gate 604 to a stop position. In this position, the control element 60 is also located in a stop position. Further displacement of the pushbutton 411, valve body 412, guide element 415, and control element 60 is no longer possible. However, the control element is now displaced far enough that the other guide element 405 or the guide elements 405, 425, 435 of all other non-actuated pushbuttons 401, 421, 431 are no longer in engagement with the control element 60 and are automatically moved upward. The resetting of the valve bodies 402, 422, 432 is in turn limited by an upper stop that is defined by the first receptacle 601 of the control element 60.

Another example embodiment that shows an alternative control element 60 is depicted in FIGS. 6*a*, 6*b*, 6*c*, and 6*d*. The control element 60 is implemented in the form of a rotatable gate disc. This, too, is rotated in opposition to the force of a return spring upon a movement of a valve body 402, 412, 422, 432. The guide elements 405, 415, 425, 435 of the valve bodies 402, 412, 422, 432 are shaped as cones at the upper end of the valve bodies 402, 412, 422, 432. The valve bodies 402, 412, 422, 432 each have a spring unit at the bottom end that acts as a return spring 404, 414, 424, 434. The gates 601 are implemented in the form of cutouts in the shape of segments of a circle with beveled surfaces or edges.

Figure 6A:
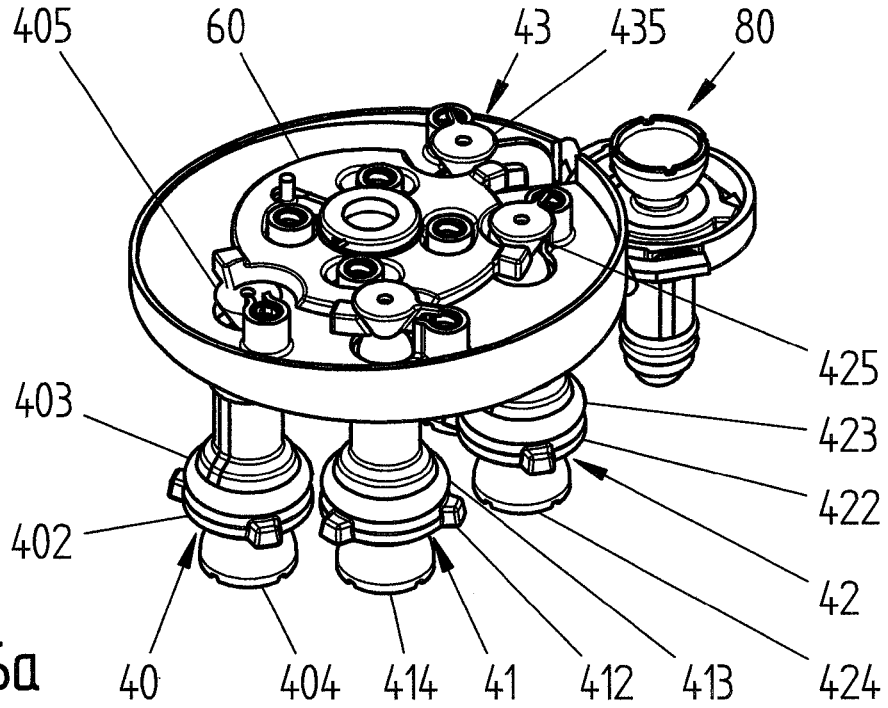
FIG. 6*a* is a perspective view of an alternative embodiment for a control element and associated valves.
Figure 6B:
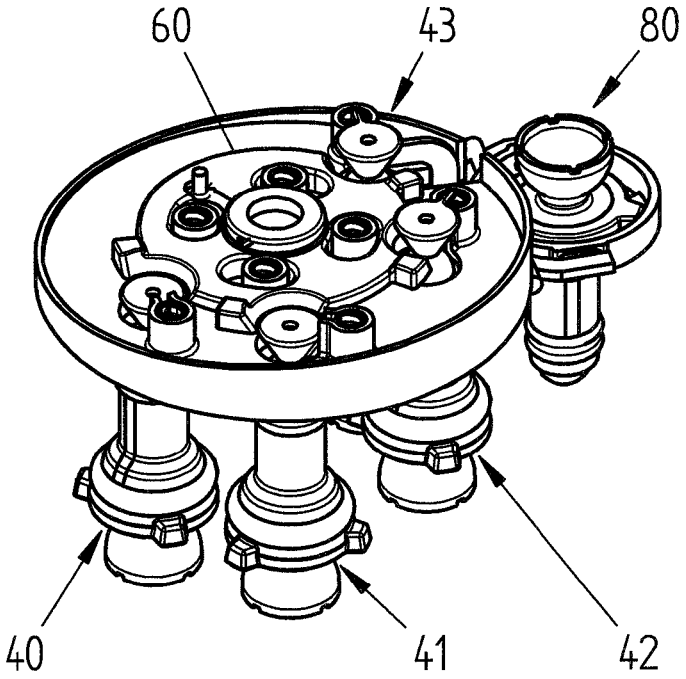
FIG. 6*b* is a perspective view from FIG. 6*a* with different valve position.
Figure 6C:
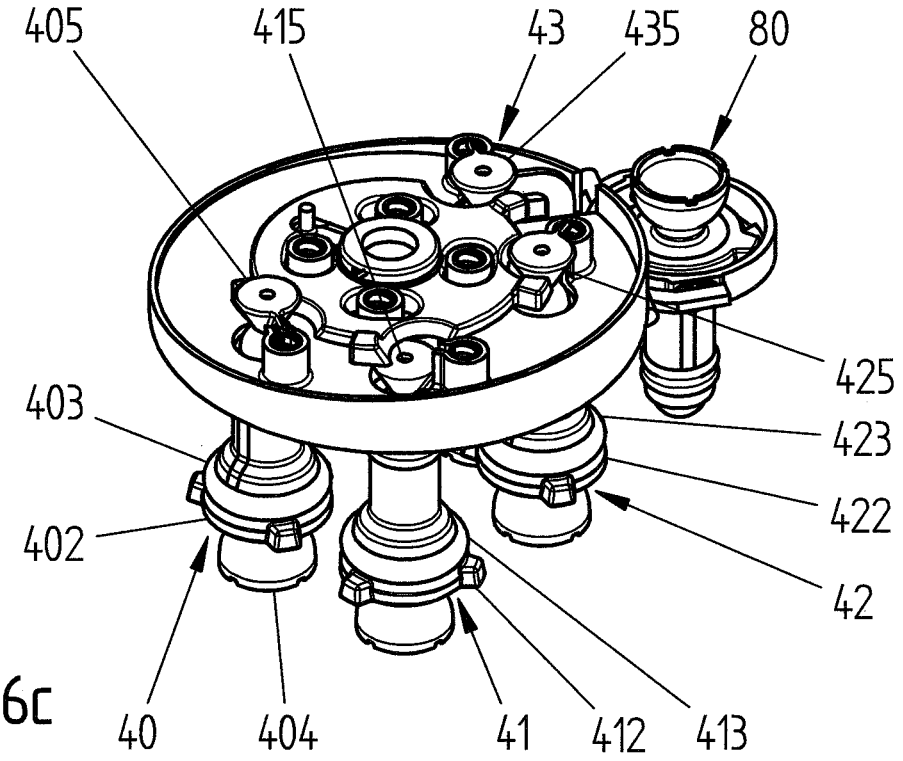
FIG. 6*c* is a perspective view from FIG. 6*a* with different valve position.
Figure 6D:
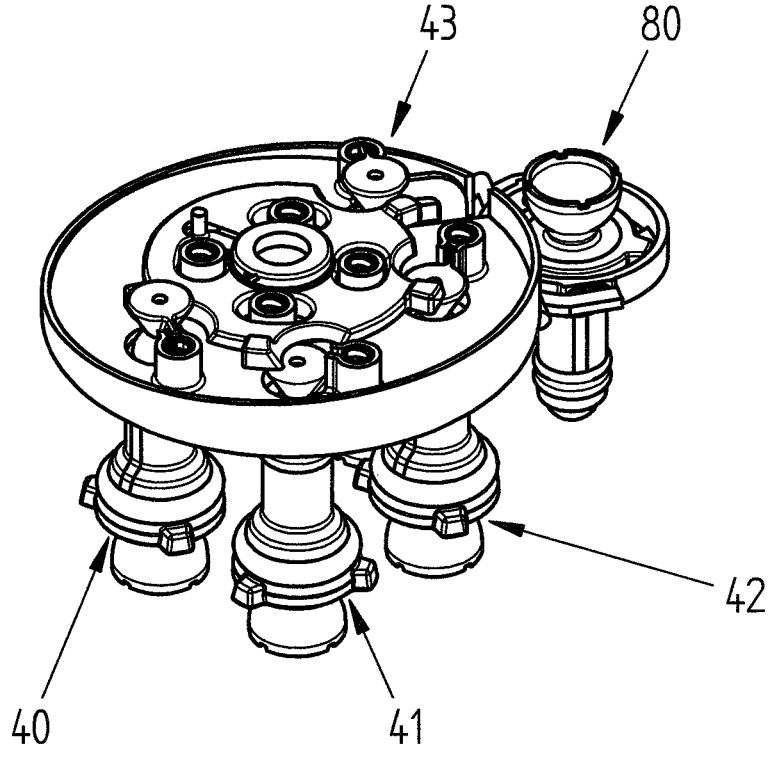
FIG. 6*d* is a perspective view from FIG. 6*a* with different valve position.

In FIG. 6*a*, the valve body 402 has been moved downward out of the first valve position into the second valve position through actuation of the associated pushbutton (not shown). During an actuation as shown in FIG. 6*b*, the guide element 405, 415 of the valve body 402, 412 slides along the gate 601 and in doing so moves the control element 60 by a specific angle of rotation. The cutout in the control element 60 in the shape of a segment of a circle is large enough that the guide element 405, 415, 425, 435 fits through it. Once the guide element 405, 415, 425, 435 arrives below the control element 60, the control element 60 rotates back because of the restoring force of the spring. As a result, the valve body 402, 412, 422, 432 is locked in the position below the control element 60 by the control element 60 itself. The resetting of the locked valve body 412 in FIG. 6*c* is accomplished by actuation of a different valve body 402, 422, 432 and the associated rotation of the control element 60. Once the corresponding recess reaches the position above the non-actuated valve body 412, the latter can return to the first valve position due to the restoring force of the spring.

In this embodiment, too, each valve 40, 41, 42, 43 can be activated directly and independently of the valve position of the remaining valves 41, 42, 43, 40. In this way, the spray types and combinations of spray types can be selected without prior deselection of the previously chosen spray type.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A showerhead or hand shower comprising:

spray outlet openings;

at least one valve configured to control an inflow of a fluid to the spray outlet openings, the at least one valve comprises a movable valve body via which at least a first and a second valve position are selectable;

a pushbutton configured to control the at least one valve;

an additional valve configured to control the inflow of a second fluid, the additional valve being coupled to the at least one valve and is controlled or actuated substantially simultaneously with the at least one valve via the pushbutton, and a movable control element that is provided for guiding and/or for locking the movable valve body in an applicable valve position and/or for automatically resetting the movable valve body from the second valve position to the first one, wherein the additional valve is coupled to the at least one valve by lever, a first end of the lever contacting the at least one valve and a second end of the lever contacting the additional valve, such that when the at least one valve is displaced via actuation of the pushbutton, the at least one valve presses the first end of the lever in a first direction to cause the second end of the lever to displace the additional valve in a second direction that is opposite to the first direction.

2. The showerhead or hand shower according to claim 1, wherein multiple fluid distribution chambers are provided in the showerhead.

3. The showerhead or hand shower according to claim 1, wherein multiple fluid distribution chambers are provided in the showerhead that are connectable with the spray outlet openings.

4. The showerhead or hand shower according to claim 2, wherein the at least one valve is arranged for each fluid distribution chamber that controls the inflow of the fluid into the fluid distribution chamber.

5. The showerhead or hand shower according to claim 1, wherein the at least one valve is adapted to control the inflow of water, air, water with dissolved additives, and/or emulsions.

6. The showerhead or hand shower according to claim 1, wherein the at least one valve is in a closed position in the first valve position and is in a flow position in the second valve position.

7. The showerhead or hand shower according to claim 1, wherein a plurality of the at least one valve are provided and wherein there are "$2^x$-1" possibilities for activating different spray types or combinations of spray types for "x" valves and associated "x" pushbuttons.

8. The showerhead or hand shower according to claim 1, wherein at least one gate guides the valve body and is provided on the control element.

9. The showerhead or hand shower according to claim 1, wherein the additional valve is not provided with a separate, respective pushbutton, such that actuation of the additional valve is provided solely through the at least one valve.

10. The showerhead or hand shower according to claim 1, wherein the movable control element is a rotatable gate disc or a translationally movable gate slide.

11. The showerhead or hand shower according to claim 10, wherein the movable control element is the rotatable gate disc and when the movable valve body is locked by the rotatable gate disc, the movable valve body is positioned below the rotatable gate disc.

12. The showerhead or hand shower according to claim 10, wherein the movable control element is the translationally movable gate slide and direction of motion of the translationally movable gate slide is perpendicular to a direction of motion of the movable valve body.

13. The showerhead or hand shower according to claim 1, wherein the additional valve cannot be activated directly.

* * * * *